US005328531A

United States Patent [19]

Gautier

[11] Patent Number: 5,328,531

[45] Date of Patent: Jul. 12, 1994

[54] PROCESS FOR THE MANUFACTURE OF COMPONENTS IN TREATED STEEL

[76] Inventor: Jacques Gautier, 4, boulevard des Loges, F-78300 Poissy, France

[21] Appl. No.: 984,275

[22] Filed: Dec. 1, 1992

Related U.S. Application Data

[63] Continuation of Ser. No. 870,802, Apr. 17, 1992, abandoned, which is a continuation of Ser. No. 746,289, Aug. 13, 1991, abandoned, which is a continuation of Ser. No. 549,161, Jul. 6, 1990, abandoned.

[30] Foreign Application Priority Data

Jul. 7, 1989 [FR] France ..... 89 09189

[51] Int. Cl.[5] ..... C21D 9/00

[52] U.S. Cl. ..... 148/580; 148/584

[58] Field of Search ..... 148/12.1, 12.4, 18, 148/20, 135, 156, 580, 584

[56] References Cited

U.S. PATENT DOCUMENTS

| | | | |
|---|---|---|---|
| 4,029,524 | 6/1977 | Takahashi et al. | 148/157 |
| 4,077,812 | 3/1978 | Tani | 148/12.4 |
| 4,088,511 | 5/1978 | Rowney | 148/12.4 |
| 4,170,495 | 10/1079 | Talikka | 148/18 |
| 4,222,799 | 9/1980 | Hijikata et al. | 148/580 |
| 4,325,751 | 4/1982 | Josefsson | 148/12.4 |
| 4,336,081 | 6/1982 | Hijikata et al. | 148/580 |
| 4,394,186 | 7/1983 | Furukawa et al. | 148/12.4 |
| 4,407,680 | 10/1983 | Gladman et al. | 148/12.4 |
| 4,544,419 | 10/1985 | Irie et al. | 148/12.4 |
| 4,568,394 | 2/1986 | Cassell | 148/580 |
| 4,960,158 | 10/1990 | Yamada et al. | 148/157 |
| 5,152,851 | 10/1992 | Yamamoto et al. | 148/580 |

FOREIGN PATENT DOCUMENTS

| | | |
|---|---|---|
| 1543101 | 10/1968 | France . |
| 2359901 | 7/1976 | France . |
| 2391789 | 12/1978 | France . |
| 2448573 | 9/1980 | France . |

OTHER PUBLICATIONS

W. Schüle Wire, Issue 104, Dec. 1969, 315-324.

Metals Handbook, 9th Edition, vol. 4 Masseria et al (ed), ASM, 1982 pp. 104 & 299.

*Primary Examiner*—Upendra Roy

*Attorney, Agent, or Firm*—Owen, Wickersham & Erickson

[57] ABSTRACT

Process for the manufacture of components from untreated steel, comprising a series of heat treatment and forming operations, characterised by heating the steel to a temperature above the transition point (austenizing), isothermal quenching in a fluidized bed bath immediately after the austenizing heating giving the steel a bainitic structure and then forming the components under mild conditions.

10 Claims, No Drawings

PROCESS FOR THE MANUFACTURE OF COMPONENTS IN TREATED STEEL

This application is a continuation of application Ser. No. 07/870,802, filed Apr. 17, 1992 now abandoned which is a continuation of application Ser. No. 870/802, filed Apr. 17, 1992, abandoned. Ser. No. 07/746,289, filed on Aug. 13, 1991, abandoned, continuation of Ser. No. 07/549,161, filed Jul. 6, 1990 abandoned.

The present invention relates to a process for the manufacture of components with high mechanical characteristics from untreated steel, comprising a series of heat treatment and forming operations.

BACKGROUND OF THE INVENTION

Conventional processes for the manufacture of components in treated steel from untreated steel in the form of bars, strips or coils, for example of springs, stabilizing bars or rail spring clips for railways, consist of a large number of operations.

As an example, the various successive operations of a conventional process for the manufacture of springs will be given below:

- unwinding of the coils, flattening, descaling and grinding,
- austenizing heating in an oven with a protective atmosphere,
- hot forming,
- oil quenching,
- tempering in an oven,
- cooling,
- clamping,
- cooling to room temperature,
- prestress shot-blasting,
- tempering after shot-blasting,
- protecting (painting or plastifying),
- curing or crosslinking,
- cooling to room temperature,
- testing.

This conventional process comprises in particular a large number of stages of change in temperature, each of which involves considerable energy expenditure and costly plant. Furthermore, hot forming and oil quenching are operations which take place in difficult working and safety conditions. Lastly, oil quenching is an operation which gives rise to pollution due to the release of harmful smoke and vapours and due to the washing to which the components must be subjected after the oil quenching.

The process according to French Patent Application No. 2,391,789 already partly remedies the disadvantages listed above. This process, intended especially for the manufacture of rail fastenings, comprises the following stages:

- forming or preforming the components cold,
- austenizing heating of the components, preferably in a fluidized bed bath or using induction,
- quenching the components in a fluidized bed bath,
- tempering the components, preferably in a fluidized bed bath,
- shot-blasting,
- optionally final cold forming of the components,
- protecting.

However, this known process still has a certain number of disadvantages. In particular, it involves two operations of raising the temperature (austenizing heating before quenching, tempering after quenching). Furthermore, since the components are subjected to a forming or at least a preforming, cold, before any heating, it is impossible to carry out this heating on continuous material, for example in strip form.

SUMMARY OF THE INVENTION

The subject of the present invention is a process for the manufacture of components in treated steel, making it possible to produce at lower cost components of a quality which is equivalent or even superior to that obtained by the usual processes.

The process in accordance with the invention for the manufacture of components from untreated steel comprises the following successive operations:

- heating the steel to a temperature above the transition point (austenizing),
- isothermal quenching in a fluidized bed bath, immediately following the austenizing heating,
- forming the components under mild conditions.

In contrast to a prejudice according to which only a forming after austenizing heating and martensite quenching made it possible to obtain components with high characteristics, it has turned out surprisingly that components obtained by forming under mild conditions after isothermal quenching (bainitic structure) exhibited mechanical and geometric characteristics (especially fatigue behaviour, stress corrosion, accuracy, closer tolerances) which were clearly improved.

Within the scope of the invention the austenizing heating can be advantageously performed in a fluidized bed bath or using induction, on continuous products (strips, coils) or on blanks or pieces. It is also possible, within the scope of the invention, to carry out a cold preforming before austenizing heating, to give the components a form other than their definitive form, in which case the forming under mild conditions which is carried out after austenizing heating and isothermal quenching is intended above all to give the components a more accurate geometry and higher mechanical characteristics (thermomechanical treatment under mild conditions, such as clamping in the case of springs).

Finally, following the forming under mild conditions, it is possible, within the scope of the invention, to carry out, without a new rise in temperature of the components, a prestress shot-blasting under mild conditions and a protecting operation under mild conditions (painting with curing, plastifying), while taking advantage of the residual heat of the components.

DESCRIPTION OF THE PREFERRED EMBODIMENT

The many advantages of the process in accordance with the invention can be categorized as follows:

ENERGY SAVING

The conventional process of hot forming before quenching requires the components to be heated as a whole to a temperature well above the transition point, to take into account the cooling which the components undergo during the hot forming operation and during the transfers.

In the process in accordance with the invention, because of the fact that the quenching operation (which gives the steel a bainitic structure) follows immediately the austenizing heating operation, the heat losses are very low and the heating temperature is lower, since it is used solely to produce the quenching.

According to the process in accordance with the invention it is furthermore necessary only to heat, and therefore to treat the working part of the metal, and this constitutes an additional gain in energy.

It should be noted that in this case the untreated part of the metal plays a complementary part in the case of the quenching and the operations which follow, via heat diffusion.

The choice of heating by induction or in a fluidized bed enables the heat exchanges to be performed in small spaces, and this appreciably decreases the losses of the plant while operating and the start-up and shut-down times of the plant, and therefore the losses arising therefrom. The replacement of oil quenching by a quenching operation in a fluidized bed eliminates the need for evacuating the oil smoke and those of washing and drying the components. In addition to the energy which these operations consume, according to the invention the complementary heating needed to compensate the losses due to the oil quenching and washing operations is saved.

The replacement of the two operations of quenching and of tempering of the usual processes by the isothermal quenching makes possible other major energy savings. Thus, the energy for bringing the component to the tempering temperature is eliminated. The period of maintaining at the isothermal quenching temperature represents less than one half of the period of maintaining at the tempering temperature according to the usual processes. The greatest proportion of the energy induced during the austenizing is released into the fluidized bath for isothermal quenching, and this enables this energy to be reused, for example for heating buildings.

On leaving the isothermal quenching, the components with a bainitic structure are at a temperature above the martensite point, that is at a temperature of the order of 280°-350° C. depending on the steel grades, and the residual energy which they contain can be employed in step with the following operations which are carried out under mild conditions (forming, clamping, prestressing, shot-blasting, protecting).

The process in accordance with the invention thus makes it possible to recover the major part of the energy introduced during the austenizing.

IMPROVEMENT IN PRODUCT QUALITY

Forming under mild conditions imparts a better accuracy to the components and increases the mechanical characteristics of the finished product by markedly promoting the blocking of the dislocations induced during the forming, especially because of the increase in the mobility of the carbon atoms which is linked with the temperature. The rapid heating followed by the isothermal quenching eliminates any risk of decarburization.

The successive operations of the process in accordance with the invention are carried out in a precise order making it possible to take maximum advantage of the energy stored in the stock. The choice of the temperature for each operation is aimed at optimizing the beneficial effects, especially from a metallurgical viewpoint in the case of the prestress shot-blasting and the preforming (or clamping), and from the electrochemical viewpoint in the case of the anticorrosion protection. In fact, in contrast to the usual processes, the process in accordance with the invention does not require the formation of a so-called priming layer generally obtained by chemical combination (phosphating) with the metal to be protected, the formation of this priming layer entailing a lowering of the surface mechanical characteristics of the components.

STOCK SAVING

The elimination of the oil quenching operation and its replacement by quenching in a fluidized bed bath save the consumption of petroleum products such as quenching oil and the washing products and water. Insofar as the process in accordance with the invention provides components of better quality, it allows the quantity of stock needed for the same single function to be reduced. From another aspect, it is possible, according to the invention, to employ less alloyed steels to obtain components which have comparable characteristics.

The possibility of employing raw metal from rolling and in coil form results in a considerable reduction in stock losses and in the price of the raw material.

SAVING IN SURFACE AREA AND CAPITAL COST

The process in accordance with the invention reduces the number of operations, especially for increasing temperature, and the periods of maintaining the temperature. The plant needed to make use of the process is therefore smaller in size.

As an example, the capital costs and the surface area required for a plant employing the process in accordance with the invention are divided by a factor of approximately five when compared with a conventional plant for producing motor vehicle suspension springs.

IMPROVEMENT IN PLANT FLEXIBILITY

The process in accordance with the invention permits a considerable reduction in the manufacturing stocks. Thus, in the case of an output of 600 suspension springs per hour, the stock is only 40 springs in the case of the process in accordance with the invention, whereas it is 1200 in the conventional process. A few minutes suffice to empty the plant of its components in order to make use of the process in accordance with the invention.

IMPROVEMENT IN WORKING AND SAFETY CONDITIONS

By virtue of the elimination of the oil quenching and by virtue of the forming under mild conditions, the process in accordance with the invention eliminates all the harmful smoke and vapours and makes the work much less arduous.

The cleanness of the plant for making use of the process in accordance with the invention and its reduced size provide a quality of the working environment and a production efficiency which are superior by far to those of the conventional process.

DECREASE IN POLLUTION

The process in accordance with the invention eliminates all the discharges (smoke, vapours, washing products, and the like) of the usual process for hot forming and oil quenching.

The series of operations, with an indication of the temperatures and times which are necessary, will be described below in the case of a conventional process for the manufacture of springs and, by way of comparison, an example of the process in accordance with the invention for the manufacture of springs of similar characteristics, intended for motor vehicle suspensions.

| Order of operations | Temperature | Time |
|---|---|---|
| CONVENTIONAL PROCESS 60 S CS STEEL | | |
| 1 - Unwinding coils | | |
| 2 - Flattening cutting | | |
| 3 - Descaling grinding | | |
| 4 - Heating in an oven with a protective atmosphere | 950° | 15' |
| 5 - Hot forming | above 800° | |
| 6 - Oil quenching (cooling) | 50° | |
| 7 - Tempering in oven | 450° | 60' |
| 8 - Cooling | 250° | |
| 9 - Clamping or prestressing or preforming | 250° | |
| 10 - Cooling to room temperature | approx. 20° | |
| 11 - Prestress shot-blasting | | |
| 12 - Tempering after shot-blasting | approximately 220° | |
| 13 - Protective painting | | |
| 14 - Paint curing | approx. 200° | |
| 15 - Cooling to room temperature | approx. 20° | |
| 16 - Testing marking | | |
| PROCESS IN ACCORDANCE WITH THE INVENTION 55 C3 OR 50 CV4 STEEL | | |
| 1 - Unwinding coils | | |
| 2 - Heating (induction or fluidized bed) | approx. 850° | 15' |
| 3 - Isothermal quenching (cooling) | approx. 320° | 15' |
| 4 - Forming under mild conditions | 300° | |
| 5 - Prestress clamping under mild conditions and testing | 280° | |
| 6 - Prestress shot-blasting | 260° | |
| 7 - Protecting (painting, plasticizing) | 220° | |

What is claimed is:

1. A method of manufacturing spring components from untreated alloy steel material containing 0.48 to 0.59% C, about 0.70 to 1.10% Cr, 0.70 to 0.90% Mn and 0.15 to 0.35% Si, comprising the steps of:

heating the steel material at a temperature above its transition point, thus austenizing the steel material, following said austenizing heating, isothermally quenching the steel material in a fluidized bed bath at a temperature above its martensite point, thus giving the steel material a bainitic structure, and without lowering the temperature substantially below said quenching temperature, mechanically forming the steel material to give it the final shape of the components.

2. The method of claim 1, comprising cold preforming of the steel material, prior to austenizing heating, to give it a preliminary shape which is different from the final shape of the components.

3. The method of claim 1, wherein a hot sitting is performed on the components following said forming, without lowering the temperature of the components substantially below the forming temperature.

4. The method of claim 1, wherein a prestress shot-blasting is performed on the components following said forming without lowering the temperature of the components substantially below the forming temperature.

5. The method of claim 1, wherein a protecting operation such as painting or plastifying of the components is conducted following said forming without lowering the temperature of the components substantially below the forming temperature.

6. The method of claim 3, wherein a prestress shot-blasting is performed on the components following said hot-sitting without lowering the temperature of the components substantially below the hot sitting temperature.

7. The method of claim 3, wherein a protecting operation such as painting or plastifying of the components is conducted following said hot sitting without lowering the temperature of the components substantially below the hot sitting temperature.

8. The method of claim 4, wherein a protecting operation such as painting or plastifying of the components is conducted following said prestress shot-blasting without lowering the temperature of the components substantially below the prestress shot-blasting temperature.

9. The method of claim 1 or 2, wherein austenizing heating is performed in a fluidized bed bath.

10. The method of claim 1 or 2, wherein austenizing heating is performed by induction heating.

* * * * *